US010189087B2

(12) United States Patent
Matsen et al.

(10) Patent No.: US 10,189,087 B2
(45) Date of Patent: Jan. 29, 2019

(54) METHODS OF MAKING PARTS FROM AT LEAST ONE ELEMENTAL METAL POWDER

(71) Applicant: The Boeing Company, Chicago, IL (US)

(72) Inventors: Marc R. Matsen, Seattle, WA (US); Matthew Douglas Carter, Portland, OR (US); Carey Eugene Wilkinson, Berkeley, MO (US); Lee C. Firth, Renton, WA (US)

(73) Assignee: THE BOEING COMPANY, Chicago, IL (US)

( * ) Notice: Subject to any disclaimer, the term of this patent is extended or adjusted under 35 U.S.C. 154(b) by 1030 days.

(21) Appl. No.: 14/176,878

(22) Filed: Feb. 10, 2014

(65) Prior Publication Data

US 2016/0107236 A1 Apr. 21, 2016

Related U.S. Application Data

(60) Provisional application No. 61/894,205, filed on Oct. 22, 2013.

(51) Int. Cl.
*B22F 3/16* (2006.01)
*B22F 3/15* (2006.01)
(Continued)

(52) U.S. Cl.
CPC ..... *B22F 3/16* (2013.01); *B22F 3/156* (2013.01); *B22F 3/24* (2013.01); *C21D 1/785* (2013.01); *B22F 2003/248* (2013.01)

(58) Field of Classification Search
CPC ..... B22F 3/04; B22F 3/16; B22F 3/24
(Continued)

(56) References Cited

U.S. PATENT DOCUMENTS 6,110,418 A 8/2000 Jablonski
7,905,128 B2 3/2011 Matsen et al.
(Continued)

FOREIGN PATENT DOCUMENTS

CN 101934373 A 1/2011
CN 102069191 5/2011
(Continued)

OTHER PUBLICATIONS

Ye, Bing, et al., "Finite-Element Modeling of Titanium Powder Densification", Metallurgical and Materials Transactions A, Jan. 2012, vol. 43A, pp. 381-390.
(Continued)

*Primary Examiner* — Weiping Zhu
(74) *Attorney, Agent, or Firm* — Patterson + Sheridan, LLP

(57) ABSTRACT

One aspect of the disclosure relates to a method of making a part from at least one elemental metal powder. The part has a near-net shape, a part volume, and a part density. The method includes providing a sintered preform having a sintered density and separating a portion from the sintered preform. The portion has a portion volume exceeding the part volume and a portion shape different from the near-net shape of the part. The method also includes thermally cycling the portion for a thermal-cycling time period at a thermal-cycling pressure while superplastically deforming the portion to form the part having the near net shape and the part density.

20 Claims, 5 Drawing Sheets

(51) Int. Cl.
*B22F 3/24* (2006.01)
*C21D 1/78* (2006.01)

(58) Field of Classification Search
USPC ..... 419/29
See application file for complete search history.

(56) References Cited

U.S. PATENT DOCUMENTS

| | | | | |
|---|---|---|---|---|
| 8,383,998 | B1 | 2/2013 | Matsen et al. | |
| 2002/0119068 | A1 | 8/2002 | Abkowitz et al. | |
| 2010/0018271 | A1* | 1/2010 | Matsen | B21D 26/02 72/19.1 |
| 2012/0015204 | A1 | 1/2012 | McCabe et al. | |
| 2014/0255240 | A1* | 9/2014 | Fang | B22F 3/101 419/29 |

FOREIGN PATENT DOCUMENTS

| | | | |
|---|---|---|---|
| CN | 102133641 | | 7/2011 |
| JP | S50-072807 | A | 6/1975 |
| JP | 2003286507 | A | 10/2003 |
| WO | 2010011847 | A1 | 1/2010 |
| WO | 2012148471 | A1 | 11/2012 |

OTHER PUBLICATIONS

Ye, Bing, et al., "Enhanced densification of Ti-6AI-4V powders by transformation-mismatch plasticity", ScienceDirect, Acta Materialia 58 (2010), pp. 3851-3859.
Extended European Search Report for EP 14189435, dated Oct. 9, 2015.
Chinese Search Report for Application No. 201405554916 dated Mar. 15, 2017.

* cited by examiner

METHODS OF MAKING PARTS FROM AT LEAST ONE ELEMENTAL METAL POWDER

RELATED APPLICATIONS

The present application claims the benefit of U.S. Provisional Patent Application No. 61/894,205, filed Oct. 22, 2013, the entire contents of which is incorporated herein by reference.

BACKGROUND

Parts made from elemental metal powders are known. However, fabrication of such parts is expensive and time consuming.

SUMMARY

Accordingly, methods of making parts from at least one elemental metal powder, intended to address the above-identified concerns, would find utility.

One example of the present disclosure relates to a method of making a part from at least one elemental metal powder with the part having a near-net shape, a part volume, and a part density. The method includes providing a sintered preform having a sintered density and separating a portion from the sintered preform. The portion has a portion volume exceeding the part volume and a portion shape different from the near-net shape of the part. The method also includes thermally cycling the portion for a thermal-cycling time period at a thermal-cycling pressure while superplastically deforming the portion to form the part having the near net shape and the part density.

BRIEF DESCRIPTION OF THE DRAWINGS

Having thus described examples of the disclosure in general terms, reference will now be made to the accompanying drawings, which are not necessarily drawn to scale, and wherein like reference characters designate the same or similar parts throughout the several views, and wherein:

FIG. 1 is a flow diagram of aircraft production and service methodology;

FIG. 2 is a block diagram of an aircraft;

FIG. 3 is a flowchart of a method of making a part from at least one elemental metal powder, according to one aspect of the present disclosure;

FIG. 4 is a sectional view of one example of an apparatus for making a near-net-shape part from at least one elemental metal powder, according to an aspect of the present disclosure;

FIG. 5 is a block diagram of one example of a system for making a near-net-shape part from at least one elemental metal powder, according to an aspect of the present disclosure;

FIG. 6 is a perspective view of one example of a near-net-shape part, according to an aspect of the present disclosure;

FIG. 7A is an elevational view of one example of a sintered preform, according to an aspect of the present disclosure; and FIG. 7B is an elevational view of the sintered preform shown in FIG. 7A with a portion of the sintered preform separated therefrom.

In the block diagram(s) referred to above, solid lines connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. Couplings other than those depicted in the block diagram(s) may also exist. Dashed lines, if any, connecting the various elements and/or components represent couplings similar in function and purpose to those represented by solid lines; however, couplings represented by the dashed lines are either selectively provided or relate to alternative or optional aspects of the disclosure. Likewise, any elements and/or components, represented with dashed lines, indicate alternative or optional aspects of the disclosure. Environmental elements, if any, are represented with dotted lines.

In the flow chart(s) referred to above, the blocks may represent operations and/or portions thereof. Moreover, lines connecting the various blocks do not imply any particular order of or dependency between the operations or portions thereof.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting.

Figure 1:
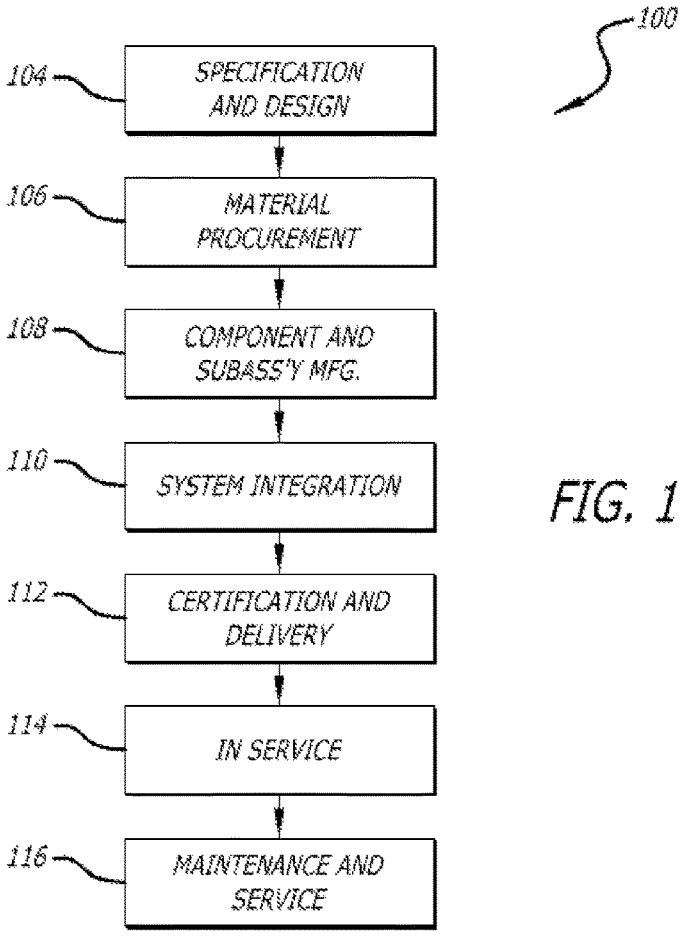
Figure 2:
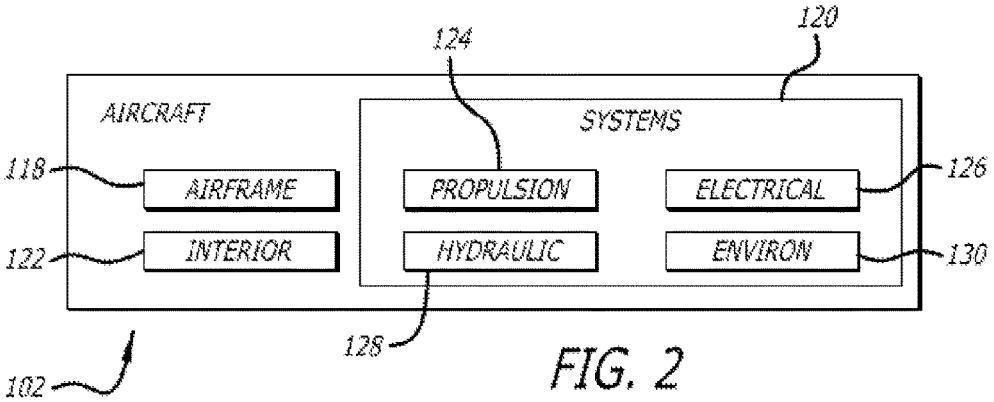

Examples of the disclosure may be described in the context of an aircraft manufacturing and service method 100 as shown in FIG. 1 and an aircraft 102 as shown in FIG. 2. During pre-production, illustrative method 100 may include specification and design 104 of the aircraft 102 and material procurement 106. During production, component and sub-assembly manufacturing 108 and system integration 110 of the aircraft take place. Thereafter, the aircraft 102 may go through certification and delivery 112 to be placed in service 114. While in service by a customer, the aircraft 102 is scheduled for routine maintenance and service 116 (which may also include modification, reconfiguration, refurbishment, and so on).

Each of the processes of the illustrative method 100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 2, the aircraft 102 produced by the illustrative method 100 may include an airframe 118 with a plurality of high-level systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the disclosure may be applied to other industries, such as the automotive industry.

Apparatus and methods shown or described herein may be employed during any one or more of the stages of the manufacturing and service method 100. For example, components or subassemblies corresponding to component and subassembly manufacturing 108 may be fabricated or manufactured in a manner similar to components or subassemblies produced while the aircraft 102 is in service. Also, one or more aspects of the apparatus, method, or combination thereof may be utilized during the production states 108 and 110, for example, by substantially expediting assembly of or reducing the cost of an aircraft 102. Similarly, one or more of apparatus or method realizations, or a combination thereof, may be utilized, for example and without limitation, while the aircraft 102 is in service, e.g., maintenance and service 116.

Figure 4:
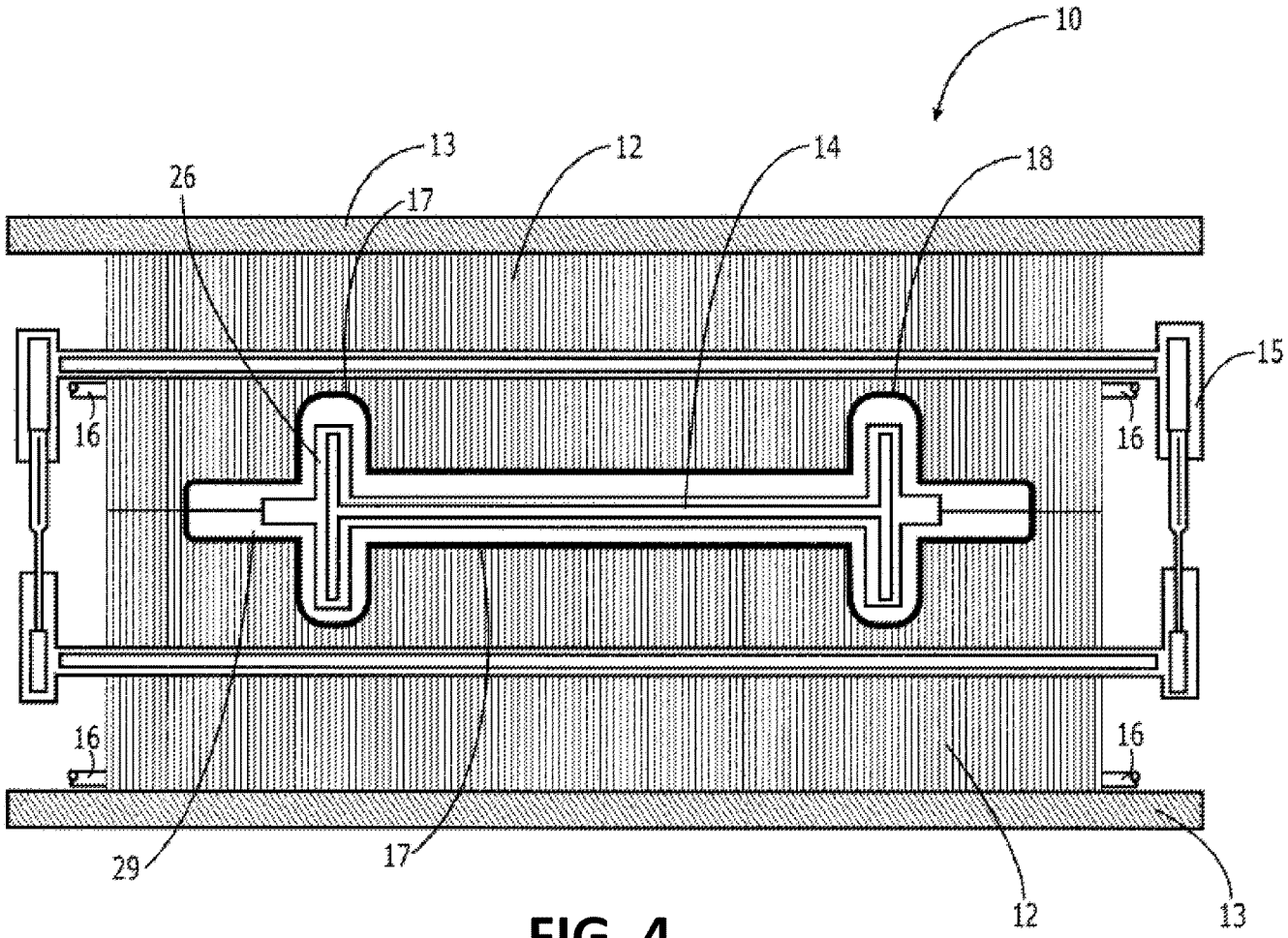

Referring to FIGS. 2 and 4, parts, such as a part 14, associated with, for example, the aircraft 102, may be made of a variety of materials and using different equipment. In one example, part 14 may be made at least partially of titanium. In another example, part 14 may be made of a combination of titanium, aluminum, and vanadium, more specifically, Ti-6Al-4V.

Figure 3:
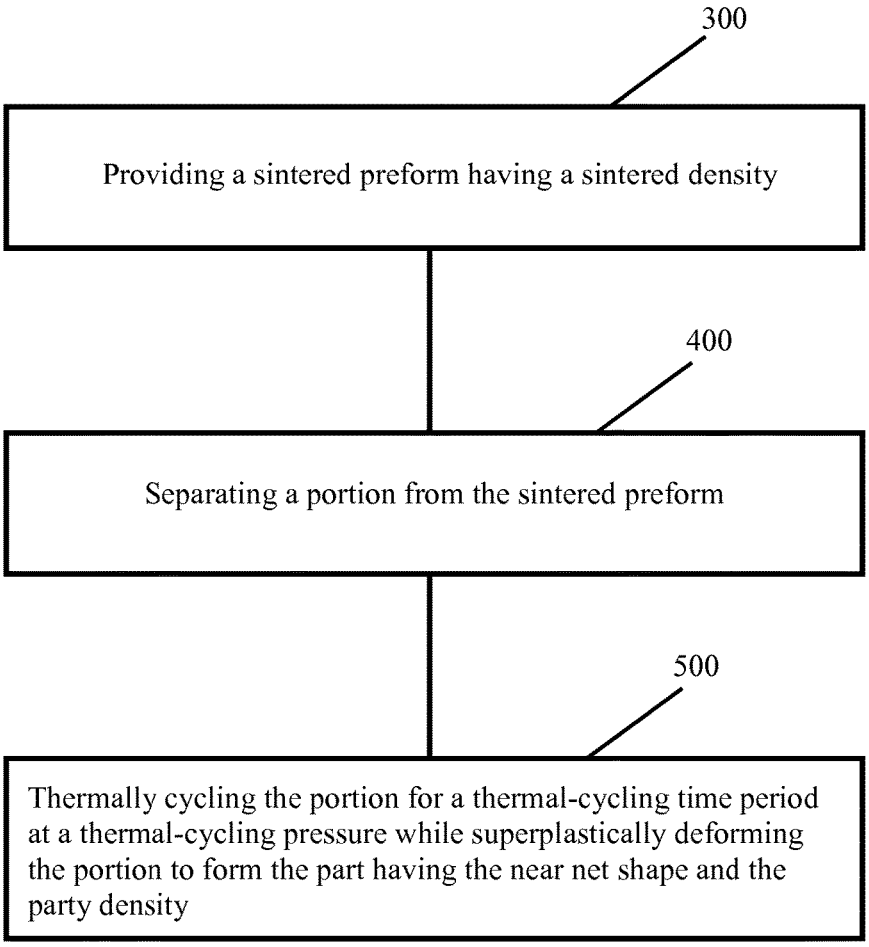

With reference to FIG. 3, one example of the present disclosure relates to a method of making the part 14 (see FIG. 4) from at least one elemental metal powder. The part 14 has a near-net shape, a part volume, and a part density. With continued reference to FIG. 3 and additional reference to FIGS. 7A and 7B, the method includes providing a sintered preform 134 having a sintered density (block 300 of FIG. 3) and separating a portion 134A from the sintered preform 134 (block 400 of FIG. 3). The portion 134A has a portion volume exceeding the part volume and a portion shape different from the near-net shape of the part 14. The method also includes thermally cycling the portion 134A for a thermal-cycling time period at a thermal-cycling pressure while superplastically deforming the portion 134A to form the part 14 having the near-net shape and the part density (block 500 of FIG. 3).

In one aspect of the disclosure, which may include at least a portion of the subject matter of any of the preceding and/or following examples and aspects, the sintered preform 134 (see FIG. 7A) is formed by sintering a cold-compacted preform for a sintering time period at a constant temperature. In one aspect of the disclosure, which may include at least a portion of the subject matter of any of the preceding and/or following examples and aspects, the constant temperature is from about 1900 degrees Fahrenheit to about 2500 degrees Fahrenheit. In one aspect of the disclosure, which may include at least a portion of the subject matter of any of the preceding and/or following examples and aspects, the sintering time period is from about 2 hours to about 20 hours.

In one aspect of the disclosure, which may include at least a portion of the subject matter of any of the preceding and/or following examples and aspects, the cold-compacted preform has a cold-compacted density and is formed by cold-compacting the at least one elemental metal powder for a cold-compacting time period at a cold-compacting temperature and a cold-compacting pressure. Cold-compacting may be achieved in a variety of ways and using different equipment. For example, cold-compacting may include cold isostatic pressing. In one aspect of the disclosure, which may include at least a portion of the subject matter of any of the preceding and/or following examples and aspects, the cold-compacted density is from about 50 percent to about 85 percent of a theoretical full density associated with the part 14. As used herein, a part would have its theoretical full density if the part had no pores therein. In one aspect of the disclosure, which may include at least a portion of the subject matter of any of the preceding and/or following examples and aspects, the cold-compacting pressure is about 60,000 pounds per square inch. In one aspect of the disclosure, which may include at least a portion of the subject matter of any of the preceding and/or following examples and aspects, the cold-compacting pressure is higher than the thermal-cycling pressure.

In one aspect of the disclosure, which may include at least a portion of the subject matter of any of the preceding and/or following examples and aspects, the sintered density is from about 80 percent to about 99 percent of the theoretical full density associated with the part 14. In one aspect of the disclosure, which may include at least a portion of the subject matter of any of the preceding and/or following examples and aspects, the sintered density is from about 95 percent to about 99.5 percent of the theoretical full density associated with the part 14.

In one aspect of the disclosure, which may include at least a portion of the subject matter of any of the preceding and/or following examples and aspects, the part density is greater than the sintered density and the sintered density is greater than the cold-compacted density. In one aspect of the disclosure, which may include at least a portion of the subject matter of any of the preceding and/or following examples and aspects, the part density is from about 99.5 percent to 100 percent of the theoretical full density associated with the part 14, the sintered density is from about 80 percent to about 95 percent of the theoretical full density, and the cold-compacted density is from about 50 percent to about 85 percent of the theoretical full density.

In one aspect of the disclosure, which may include at least a portion of the subject matter of any of the preceding and/or following examples and aspects, forming the cold-compacted preform further includes attriting the at least one elemental metal powder before cold-compacting the at least one elemental metal powder. Attriting may be achieved in a variety of ways and by a variety of apparatuses. In one aspect, attriting may include grinding or otherwise breaking-up the at least one elemental metal powder into finer particles and, in examples and/or aspects where a plurality of elemental metal powders are used, attriting may additionally include mixing the plurality of elemental metal powders. In one aspect, the at least one elemental metal powder is placed into a drum with heavy spherical members positioned therein. Rotating the drum moves the members within the drum, thereby grinding the at least one elemental powder into finer particles and mixing the at least one elemental powder.

In one aspect of the disclosure, which may include at least a portion of the subject matter of any of the preceding and/or following examples and aspects, the method also includes processing the part 14 after deforming the portion 134A to the near net shape to change the near net shape to a net shape. The part 14 may be processed in a variety of ways. For example, the part 14 may be machined, ground, polished, cut, punched, drilled, or may undergo any other type of post-processing.

In one aspect of the disclosure, which may include at least a portion of the subject matter of any of the preceding and/or following examples and aspects, the portion 134A (see FIGS. 7A and 7B) is thermally cycled between a first temperature and a second temperature. Thermal cycling may occur at a variety of different rates and between a variety of different maximum and minimum temperatures. In one aspect of the disclosure, the first temperature may be about 1580 degrees Fahrenheit and the second temperature may be about 1870 degrees Fahrenheit. In another aspect of the disclosure, the first temperature may be about 1450 degrees Fahrenheit and the second temperature may be about 2000 degrees Fahrenheit.

In one aspect of the disclosure, which may include at least a portion of the subject matter of any of the preceding and/or following examples and aspects, the portion 134A (see FIGS. 7A and 7B) is thermally cycled for a number of thermal cycles. In one aspect of the disclosure, which may include at least a portion of the subject matter of any of the preceding and/or following examples and aspects, the number of thermal cycles is from about 5 to about 40. In another aspect of the disclosure, which may include at least a portion of the subject matter of any of the preceding and/or following examples and aspects, the number of thermal cycles is from about 10 cycles to about 20 cycles.

In one aspect of the disclosure, which may include at least a portion of the subject matter of any of the preceding and/or following examples and aspects, the thermal-cycling time period is less than about an hour.

In one aspect of the disclosure, which may include at least a portion of the subject matter of any of the preceding and/or following examples and aspects, each of the thermal cycles causes a crystallographic change of a material of the portion 134A, as discussed in more detail below.

In one aspect of the disclosure, which may include at least a portion of the subject matter of any of the preceding and/or following examples and aspects, the portion 134A (see FIGS. 7A and 7B) is thermally cycled in an inert atmosphere. Thermally cycling the portion 134A in the inert atmosphere minimizes oxidation. One example of an inert atmosphere includes an argon atmosphere.

In one aspect of the disclosure, which may include at least a portion of the subject matter of any of the preceding and/or following examples and aspects, the at least one elemental metal powder is at least one of a titanium powder, an aluminum powder, and a vanadium powder.

In one aspect of the disclosure, which may include at least a portion of the subject matter of any of the preceding and/or following examples and aspects, the part 14 (see FIG. 4) is made from a plurality of elemental metal powders. In one aspect of the disclosure, which may include at least a portion of the subject matter of any of the preceding and/or following examples and aspects, the plurality of elemental metal powders include at least two of the titanium powder, the aluminum powder, and the vanadium powder.

In one aspect of the disclosure, which may include at least a portion of the subject matter of any of the preceding and/or following examples and aspects, the thermal-cycling pressure is constant. In one aspect of the disclosure, which may include at least a portion of the subject matter of any of the preceding and/or following examples and aspects, the thermal-cycling pressure is about 2000 pounds per square inch. In one aspect of the disclosure, which may include at least a portion of the subject matter of any of the preceding and/or following examples and aspects, the thermal-cycling pressure can be varied from about 1 kilopound per square inch to about 4 kilopounds per square inch.

Figure 7A:
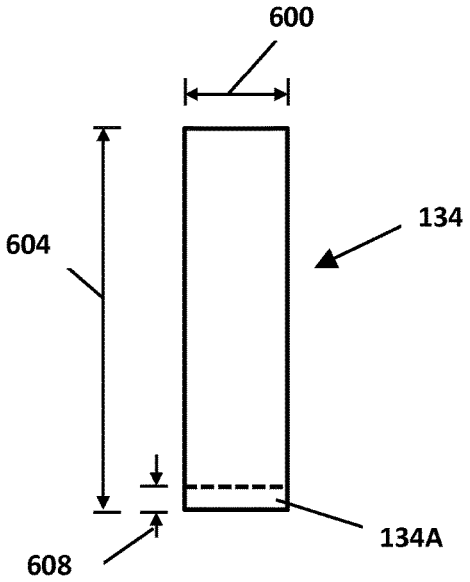
Figure 7B:
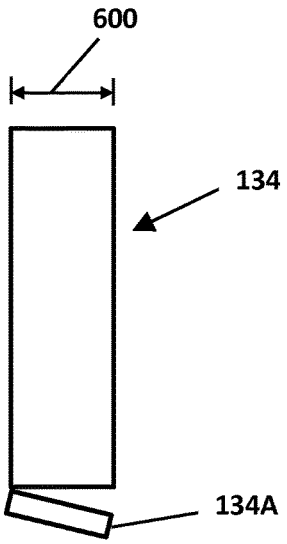

With reference to FIGS. 7A and 7B, in one aspect of the disclosure, which may include at least a portion of the subject matter of any of the preceding and/or following examples and aspects, the sintered preform 134 has a cylindrical shape. In one aspect of the disclosure, which may include at least a portion of the subject matter of any of the preceding and/or following examples and aspects, the sintered preform 134 has a diameter 600 and a first height 604, and the portion 134A of the sintered preform 134 has the diameter 600 of the sintered preform 134 and has a second height 608 less than the first height 604.

With continued reference to FIGS. 7A and 7B, the sintered preform 134 may have a variety of shapes, such as cubic or cylindrical. Preferably, the sintered preform 134 is shaped so that the volume of the portion 134A may be easily calculated from the dimensions thereof.

The disclosure and drawing figure(s) describing the operations of the method(s) set forth herein should not be interpreted as necessarily determining a sequence in which the operations are to be performed. Rather, although one illustrative order is indicated, it is to be understood that the sequence of the operations may be modified when appropriate. Additionally, in some aspects of the disclosure, not all operations described herein need be performed.

Figure 5:
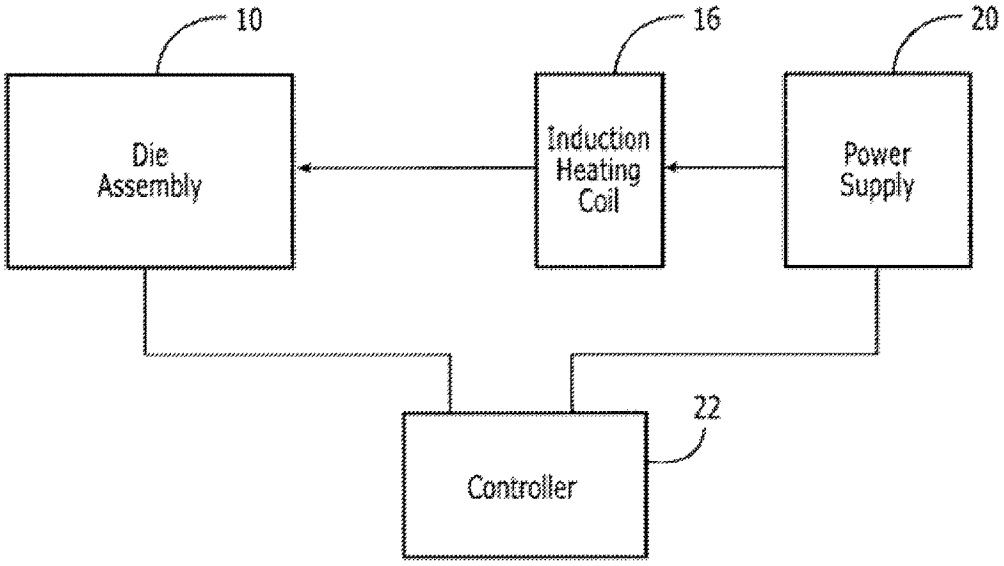

With reference to FIGS. 4 and 5, one example of an apparatus 10 for forming the part 14 in accordance with the present disclosure is illustrated. The apparatus 10 includes a die assembly including two or more dies 12, such as the first and second co-operable dies, as shown in FIG. 4. The dies are typically formed of a strong and rigid material and are also formed of a material having a melting point well above the processing temperature of the part 14. Additionally, the dies 12 can be formed of a material characterized by a low thermal expansion, high thermal insulation, and a low electromagnetic absorption. For example, each of the dies 12 may include multiple stacked metal sheets, such as stainless steel sheets or sheets formed of an Inconel® 625 alloy, which are trimmed to the appropriate dimensions for the induction coils (described below). The stacked metal sheets may be oriented in generally perpendicular relationship with respect to the respective contoured die surfaces. Each metal sheet may have a thickness from about 1/16" to about 1/4", for example, and preferably about 0.200". An air gap may be provided between adjacent stacked metal sheets to facilitate cooling of the dies, such as a gap of about 0.15". The stacked metal sheets may be attached to each other using clamps (not shown), fasteners (not shown) and/or other suitable techniques. The stacked metal sheets may be selected based on their electrical and thermal properties and may be transparent to the magnetic field. An electrically insulating coating (not shown) may optionally be provided on each side of each stacked sheet to prevent flow of electrical current between the stacked metal sheets. The insulating coating may be a material such as a ceramic material, for example. Multiple thermal expansion slots may be provided in the dies to facilitate thermal expansion and contraction of the stacked tooling apparatus 10.

The die assembly can also include two or more strongbacks 13 to which the dies 12 are mounted. As shown in FIG. 4, for example, the first and second dies 12 may be mounted to and supported by first and second strongbacks 13, respectively. A strongback 13 is a stiff plate, such as a metal plate, that acts as a mechanical constraint to keep the dies 12 together and to maintain the dimensional accuracy of the dies 12. The die assembly also generally includes an actuator, shown generically as 15 in FIG. 4, for controllably moving the dies 12 toward and away from one another, such as by moving the dies 12 toward one another so as to apply a predetermined amount of pressure to the part 14. Various types of actuators may be employed including, for example, hydraulic, pneumatic, or electric rams.

As shown in section in FIG. 4, the dies 12 define an internal cavity. In embodiments in which the part 14 is formed by hot pressing operations, such as vacuum hot pressing or hot isostatic pressing, the internal cavity defined by the dies 12 may serve as the die cavity in which the part 14 is disposed. In the example depicted in FIGS. 4 and 5, however, the apparatus 10 for forming the part 14 includes one or more induction coils 16 that extend through the dies 12 to facilitate selective heating of the dies 12. A thermal control system may be connected to the induction coils. A susceptor may be thermally coupled to the induction coils of each die 12. Each susceptor may be a thermally-conductive material such as a ferromagnetic material, cobalt, iron or nickel, for example. Each susceptor may generally conform to the first contoured die surface of the respective die.

Electrically and thermally insulative coatings 17, i.e., die liners, may be provided on the contoured die surfaces of the dies 12. The electrically and thermally insulative coating may be, for example, alumina or silicon carbide and, more particularly, a SiC matrix with SiC fibers. The susceptors may, in turn, be provided on the electrically and thermally insulative coatings of the respective dies.

A cooling system may be provided in each die 12. The cooling system may include, for example, coolant conduits which have a selected distribution throughout each die 12. The coolant conduit may be adapted to discharge a cooling medium into the respective die 12. The cooling medium may be a liquid, gas or gas/liquid mixture which may be applied as a mist or aerosol, for example.

The susceptor 18 is responsive to electromagnetic energy, such as an oscillating electromagnetic field, generated by the induction heating coils 16. In response to the electromagnetic energy generated by the induction heating coils, the susceptor is heated which, in turn, heats the part 14. In contrast to techniques in which the dies are heated and cooled, induction heating techniques can more quickly heat and cool a part 14 in a controlled fashion as a result of the relatively rapid heating and cooling of the susceptor. For example, some induction heating techniques can heat and cool a part 14 about two orders of magnitude more quickly than conventional autoclave or hot isostatic pressing (HIP) processes. In one embodiment, the susceptor is formed of ferromagnetic materials including a combination of iron, nickel, chromium and/or cobalt with the particular material composition chosen to produce a set temperature point to which the susceptor is heated in response to the electromagnetic energy generated by an induction heating coil. In this regard, the susceptor may be constructed such that the Curie point of the susceptor at which there is a transition between the ferromagnetic and paramagnetic phases of the material defines the set temperature point to which the susceptor is inductively heated. Moreover, the susceptor may be constructed such that the Curie point is greater, albeit typically only slightly greater, than the phase transformation temperature of the part 14.

Figure 6:
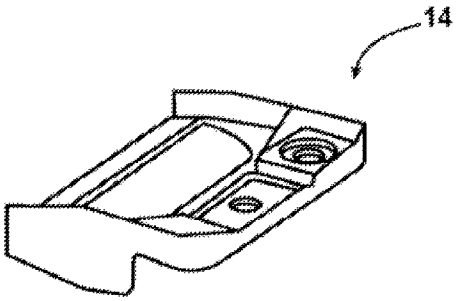

As also shown in FIG. 4, a part 14 is disposed within the die cavity. As described below, the method and apparatus 10 can form parts to have a desired complex configuration in which different portions of the part 14 extend in different directions. However, the method and apparatus can form parts having any desired configuration. As such, the method and apparatus can form parts 14 for a wide variety of applications. In this regard, the method and apparatus can form parts for aerospace, automotive, marine, construction, structural and many other applications. As shown in FIG. 6, for example, a connector plate for connecting a floor beam to the fuselage of an aircraft is formed and depicts one example of a complexly configured part 14 that can be formed in accordance with embodiments of the method and apparatus of the present disclosure.

The part 14 may also be formed of a variety of materials, but is typically formed of a metal alloy that experiences a phase change between two solid phases at an elevated temperature and pressure, that is, at a temperature and pressure greater than ambient temperature and pressure and, typically, much greater than ambient temperature and pressure. For example, the metal alloy forming the part 14 may be a steel or iron alloy. In one example, however, the part 14 is formed of a titanium alloy, such as Ti-6-4 formed of 6% (weight percent) aluminum, 4% (weight percent) vanadium and 90% (weight percent) titanium. Under equilibrium conditions at room temperature, Ti-6-4 contains two solid phases, that is, a hexagonal close-packed phase, termed the alpha phase, which is more stable at lower temperatures and a body-centered cubic phase, termed the beta phase, which is more stable at higher temperatures. At equilibrium conditions at room temperature, Ti-6-4 is a mixture of the beta phase and the alpha phase with the relative amount of each phase being determined by thermodynamics. As the temperature is increased, the alpha phase transforms to the beta phase over a phase transformation temperature range until the alloy becomes entirely formed of the beta phase at temperatures above the beta transus temperature. By way of example, for Ti-6-4, the beta transus temperature is approximately 1000 degrees Celsius. Similarly, the Ti-6-4 will gradually change from the beta phase to the alpha phase as the temperature is decreased below the beta transus temperature over a phase transformation range. While for titanium alloys, the transformation from the hexagonal close packed phase to the body centered cubic phase occurs over a temperature range, for pure titanium, the transformation occurs at a single temperature value, about 880 degrees Celsius. Reference herein to a phase transformation temperature range includes both a range including a plurality of temperatures as well as a single temperature value. Additionally, the beta transus temperature varies depending upon the exact composition of the alloys.

Accompanying the microstructural rearrangement of atoms during the transformation from the alpha phase to the beta phase are changes in the lattice parameters for each of the phases due to changes in the temperature. These changes in the lattice parameters result in a positive volume change. This microstructural change in volume results in an instantaneous increase in strain rate upon heating of the alloy which, in turn, enables a given quantity of deformation to be produced in response to lower applied pressures or, stated differently, more deformation to be produced at a given pressure. By taking advantage of the phase transformation superplasticity of the part 14 at temperatures within or proximate the phase transformation temperature range, the part 14 may be consolidated at lower pressures and temperatures than conventional techniques.

As also shown FIG. 4, in one aspect of the disclosure, the apparatus 10 for forming a part 14 employs a hydrostatic pressing medium 26 disposed within the die cavity so as to be proximate at least one side of the part 14. While the hydrostatic pressing medium need only be proximate one side of the part 14, the hydrostatic pressing medium may surround or encapsulate the part 14 so as to be proximate each size of the part 14, as in the illustrated embodiment. While the hydrostatic pressing medium may be disposed within the die cavity prior to insertion of the part 14 so as to be distinct from the part 14, the hydrostatic pressing medium may be coated or otherwise disposed upon the part 14 prior to the insertion of the part 14 into the die cavity such that the part 14 carries the hydrostatic pressing medium.

The hydrostatic pressing medium 26 is configured to be a liquid having a relatively high viscosity at the processing pressure and temperatures at which the method and apparatus 10 of embodiments of the present disclosure consolidate the part 14. In this regard, the viscosity of the liquid may be at or close to the working point within the phase transformation temperature range. For example, the viscosity may range from about $10^3$ poise to about $10^6$ poise for temperatures within the phase transformation temperature range. Additionally, the liquid generally has a low heat capacity, is transparent to radiant energy, is electrically nonconductive and has a relatively high thermal conductivity. In this regard, the hydrostatic pressing medium may be an amorphous material, such as glass. Additionally, the hydrostatic pressing medium is advantageously non-reactive with the part 14 at the elevated temperatures at which the part 14 will be processed and consolidated.

In one embodiment, the hydrostatic pressing medium 26 may be formed of two layers of glass first layer proximate the preform and a second layer on the opposite side of the first layer from the preform such that the second layer is spaced from the preform by the first layer. In this embodiment, the first layer is typically stiffer than the second layer, thereby reducing the infiltration of the glass into voids in the part 14.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

Having the benefit of the teachings presented in the foregoing description and the associated drawings, many modifications of the disclosed subject matter will become apparent to one skilled in the art to which this disclosure pertains. Therefore, it is to be understood that the disclosure is not to be limited to the specific examples and aspects provided and that modifications thereof are intended to be within the scope of the appended claims. Moreover, although the foregoing disclosure and the associated drawings describe certain illustrative combinations of elements and/or functions, it should be appreciated that different combinations of elements and/or functions may be realized without departing from the scope of the appended claims.

What is claimed is:

1. A method of making a part from at least one elemental metal powder, the part having a near-net shape, a part volume, and a part density, the method comprising:

providing a sintered preform having a sintered density;

separating a portion from the sintered preform, the portion having a portion volume exceeding the part volume and a portion shape different from the near-net shape of the part; and thermally cycling the portion for a thermal-cycling time period at a thermal-cycling pressure while superplastically deforming the portion to form the part having the near net shape and the part density.

2. The method of claim 1, wherein the sintered preform is formed by sintering a cold-compacted preform for a sintering time period at a constant temperature.

3. The method of claim 2, wherein the constant temperature is from about 1900 degrees Fahrenheit to about 2500 degrees Fahrenheit.

4. The method of claim 2, wherein the sintering time period is from about 2 hours to about 20 hours.

5. The method of claim 2, wherein the cold-compacted preform has a cold-compacted density and is formed by cold-compacting the at least one elemental metal powder for a cold-compacting time period at a cold-compacting temperature and a cold-compacting pressure.

6. The method of claim 5, wherein the cold-compacted density is from about 50 percent to about 85 percent of a theoretical full density associated with the part.

7. The method of claim 5, wherein the cold-compacting pressure is higher than the thermal-cycling pressure.

8. The method of claim 7, wherein the part density is greater than the sintered density and the sintered density is greater than the cold-compacted density.

9. The method of claim 5, wherein forming the cold-compacted preform further includes attriting the at least one elemental metal powder before cold-compacting the at least one elemental metal powder.

10. The method of claim 1, further comprising processing the part after deforming the portion to the near-net shape to change the near-net shape to a net shape.

11. The method of claim 1, wherein the portion is thermally cycled between a first temperature and a second temperature.

12. The method of claim 11, wherein the portion is thermally cycled for a number of thermal cycles.

13. The method of claim 12, wherein each of the thermal cycles causes a crystallographic change of a material of the portion.

14. The method of claim 1, wherein the thermal-cycling time period is less than about an hour.

15. The method of claim 1, wherein the part is made from a plurality of elemental metal powders.

16. The method of claim 1, wherein the sintered density is from about 80 percent to about 99 percent of full density.

17. The method of claim 1, wherein the sintered density is from about 95 percent to about 99 percent of a theoretical full density associated with the part.

18. The method of claim 1, wherein the thermal-cycling pressure is constant.

19. The method of claim 1, wherein the sintered preform has a cylindrical shape.

20. The method of claim 19, wherein the sintered preform has a diameter and a first height, and wherein the portion of the sintered preform has the diameter of the sintered preform and has a second height less than the first height.

* * * * *